US009441856B2

(12) United States Patent
Barendregt

(10) Patent No.: US 9,441,856 B2
(45) Date of Patent: Sep. 13, 2016

(54) STEAM GENERATOR

(71) Applicant: Certek Heat Machine Inc., Wembley (CA)

(72) Inventor: Jeremy Barendregt, Wembley (CA)

(73) Assignee: Certek Heat Machine Inc., Wembley, Alberta (CA)

( * ) Notice: Subject to any disclaimer, the term of this patent is extended or adjusted under 35 U.S.C. 154(b) by 120 days.

(21) Appl. No.: 14/174,410

(22) Filed: Feb. 6, 2014

(65) Prior Publication Data

US 2015/0219362 A1 Aug. 6, 2015

(51) Int. Cl.

| | |
|---|---|
| ***F24H 1/00*** | (2006.01) |
| ***F24H 1/08*** | (2006.01) |
| ***F24H 1/10*** | (2006.01) |
| ***F01K 5/02*** | (2006.01) |

(52) U.S. Cl.

CPC . *F24H 1/08* (2013.01); *F01K 5/02* (2013.01); *F24H 1/0009* (2013.01); *F24H 1/107* (2013.01)

(58) Field of Classification Search

CPC ..... F24H 1/0009; F24H 1/0072; F24H 1/08; F24H 1/12

See application file for complete search history.

(56) References Cited

U.S. PATENT DOCUMENTS

| | | | | |
|---|---|---|---|---|
| 3,522,909 | A * | 8/1970 | Arant | 239/127 |
| 3,785,363 | A * | 1/1974 | Machado | 122/33 |
| 3,814,321 | A * | 6/1974 | Mulholland et al. | 239/135 |
| 4,414,037 | A * | 11/1983 | Friedheim | 134/35 |
| 4,461,223 | A * | 7/1984 | Masaki | 110/215 |
| 5,044,142 | A | 9/1991 | Gianelli | |
| 6,299,076 | B1 * | 10/2001 | Sloan et al. | 239/136 |
| 7,627,926 | B2 * | 12/2009 | Williams | 15/320 |
| 2012/0097151 | A1 * | 4/2012 | Matsuno et al. | 126/615 |

FOREIGN PATENT DOCUMENTS

| | | | |
|---|---|---|---|
| JP | S646603 | A | 1/1989 |
| KR | 20120008721 | A | 2/2012 |
| WO | WO2011/142414 | A1 | 11/2011 |

OTHER PUBLICATIONS

Canada Intellectual Property Office, International Search Report and Written Opinion mailed Oct. 20, 2015 in PCT/IB2015/000951 (total 7 pages).

* cited by examiner

*Primary Examiner* — Ryan Reis
(74) *Attorney, Agent, or Firm* — Barclay Damon, LLP

(57) ABSTRACT

A steam generator having a channel for circulating heated fluid through a heat exchanger and having a channel for supplying water through the heat exchanger. The steam side of the heat exchanger is maintained at a pressure lower than the outside atmosphere and is heated by the heating fluid to a temperature more than the boiling point of the water at the lowered pressure. The water being introduced to the heat exchanger is heated to a boil. The steam produced is less than the boiling point of water in the atmosphere. A vacuum pump draws the steam from the heat exchanger and ejects the steam through a steam hose into atmospheric pressure. This rise in pressure is accompanied by a rise in temperature of the steam above the boiling point of water at atmospheric pressure.

15 Claims, 2 Drawing Sheets

STEAM GENERATOR

FIELD OF THE INVENTION

This invention relates to steam generation. More particularly, the invention relates to an apparatus and method for easily and inexpensively generating a source of steam that can be manually manipulated and aimed to heat cold or frozen objects.

BACKGROUND OF THE INVENTION

Industrial equipment used in cold environments may require heating and thawing of components, or removal of ice from various parts thereof. Presently, various heat generating instruments are used to heat such low temperature components by blowing heated air or by directly physically attaching heating lines to the components either on their exterior surfaces or within interior recesses. The heating lines may include wires, grates, or fluid carrying heating pipes, or other suitable devices. Some of these devices suffer from inefficiencies and some may require that the equipment be modified to attach or insert the heating devices which incurs unnecessary expense and may be labor intensive.

It is desired to provide a system, apparatus, and method to effectively and quickly heat objects and equipment with a minimal amount of hardware and manpower. The discussion above is merely provided for general background information and is not intended to be used as an aid in determining the scope of the claimed subject matter.

SUMMARY OF THE INVENTION

A steam generator having a channel for circulating heated fluid through a heat exchanger and having a channel for supplying water through the heat exchanger is disclosed. The heat exchanger is maintained at a pressure less than that of the outside atmosphere to heat water and convert it to steam in the heat exchanger at a temperature less than the boiling point of the water in the outside atmosphere. A vacuum blower draws the steam from the heat exchanger and discharges the steam through a hose at the atmospheric pressure which maintains the moisture in the gaseous phase as steam. An advantage that may be realized in the practice of some disclosed embodiments of this steam generator is a simple, efficient, and inexpensive apparatus, system, and method for thawing and heating industrial equipment.

In one embodiment, an apparatus comprises a heater for heating fluid and for circulating the heated fluid through a heat exchanger. A water supply provides water to be heated into the heat exchanger. The heat exchanger heats the incoming water to a boiling point of the water at the lowered pressure within the heat exchanger and converts it to steam. A vacuum pump maintains a lower than atmospheric pressure within the heat exchanger and draws the steam from the heat exchanger and ejects it through a hose wherein the hose may be used to direct the steam as desired.

In another embodiment, a method of generating steam comprises maintaining a pressure in a water line and within a heat exchanger at less than atmospheric pressure using a vacuum source. The water in the water line is heated at the less than atmospheric pressure, is converted to steam and is discharged into an environment at atmospheric pressure using the vacuum source.

In another embodiment, a steam generator comprises a supply of water, a boiler for heating fluid, a heat exchanger for receiving the heated fluid and the supply of water in order to heat the water above a boiling point of the water at a lowered pressure. A vacuum pump maintains a pressure within the heat exchanger at less than atmospheric pressure, draws the steam generated in the heat exchanger, and ejects the steam into an environment at the atmospheric pressure.

This brief description of the invention is intended only to provide a brief overview of subject matter disclosed herein according to one or more illustrative embodiments, and does not serve as a guide to interpreting the claims or to define or limit the scope of the invention, which is defined only by the appended claims. This brief description is provided to introduce an illustrative selection of concepts in a simplified form that are further described below in the detailed description. This brief description is not intended to identify key features or essential features of the claimed subject matter, nor is it intended to be used as an aid in determining the scope of the claimed subject matter. The claimed subject matter is not limited to implementations that solve any or all disadvantages noted in the background.

BRIEF DESCRIPTION OF THE DRAWINGS

These, and other, aspects and objects of the present invention will be better appreciated and understood when considered in conjunction with the following description and the accompanying drawings. It should be understood, however, that the following description, while indicating preferred embodiments of the present invention and numerous specific details thereof, is given by way of illustration and not of limitation. For example, the summary descriptions above are not meant to describe individual separate embodiments whose elements are not interchangeable. In fact, many of the elements described as related to a particular embodiment can be used together with, and possibly interchanged with, elements of other described embodiments. Many changes and modifications may be made within the scope of the present invention without departing from the spirit thereof, and the invention includes all such modifications. It is to be understood that the attached drawings are for purposes of illustrating the concepts of the invention. The figures below are intended to be drawn neither to any precise scale with respect to relative size, angular relationship, or relative position nor to any combinational relationship with respect to interchangeability, substitution, or representation of an actual implementation.

DETAILED DESCRIPTION OF THE INVENTION

Figure 1:
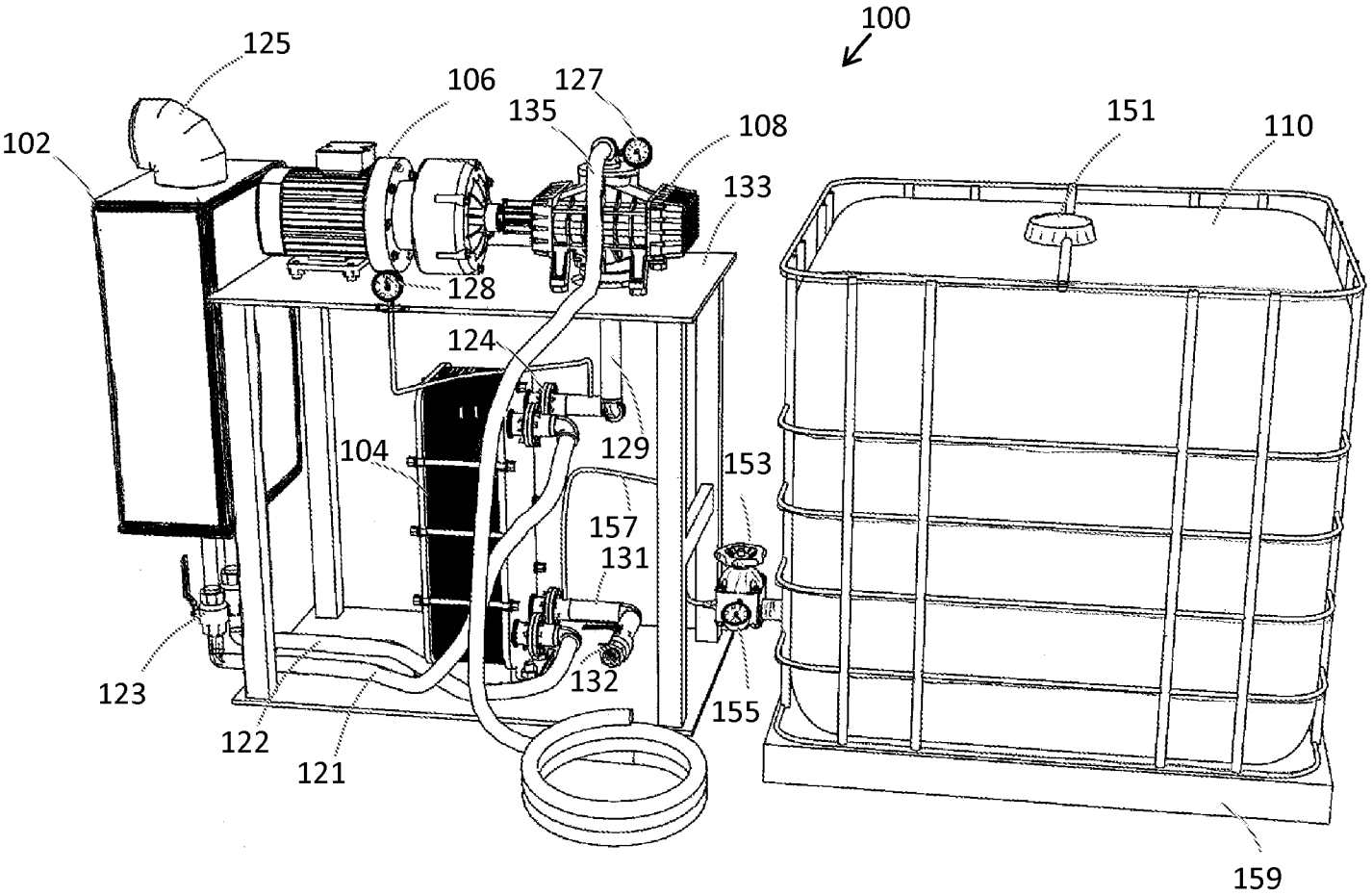
FIG. 1 is a perspective view of an exemplary steam generator.

Referring to FIG. 1, there is illustrated a steam generator system 100. The steam generator comprises a boiler 102, such as a glycol boiler, with vent 125, that heats a fluid, such as a glycol based fluid, and delivers the heated fluid into a heat exchanger 104. The boiler 102 is fluidly coupled to the heat exchanger 104 via a heating fluid supply channel 121 for delivering the heated fluid thereto, and a heating fluid return channel 122 for receiving heated fluid traveling back from the heat exchanger. Thus, in operation, the boiler 102 continuously heats the fluid and circulates it through the heat exchanger 104 and back to the boiler 102, thereby maintaining the fluid at a substantially consistent temperature as it travels through the heat exchanger 104. The supply and return channels 121, 122 may be made from a high temperature rubber tube or steel pipe sized at about one and one half inches, for example. A valve 123 with a manually operated valve handle may be attached to the heating fluid supply tube 121, the heating fluid return tube 122, or both, to close off, reduce, or otherwise control the flow of heating fluid therethrough. The boiler may be set to maintain the fluid at a temperature less than a boiling port of water at one standard atmosphere using a standard temperature control mechanism for the boiler, such as a thermostatic controller. In one embodiment, the boiler may comprise a glycol boiler heating a glycol based fluid between about 160° F. and 200° F., and more preferably between about 160° F. and about 190° F., and even more preferably at about 180° F. The boiler 102 may be a gas or oil fueled boiler, or it may be an electric boiler, or other suitably energized boiler. The heating fluid supply channel 121 and heating fluid return channel 122 are preferably made from a thermally conductive material, such as steel or copper, in the portions of the channels that are disposed in the boiler and the heat exchanger, and may be made from a different material in the portion outside of the heat exchanger and the boiler, or they may be insulated in these outside portions.

A water tank 110 holding about 50 gallons to about 500 gallons of water, preferably about 150 gallons to about 400 gallons, and even more preferably about 250 gallons of water, supplies water to the heat exchanger through a water supply channel 157 which is fluidly coupled to the water tank via an opening at one side of the tank close to a bottom side of the water tank. The water tank 110 may be supported by a rigid or semi-rigid base 159 and includes a capped fill hole 151 on a top side of the water tank. The water flowing through the water supply channel may be controlled by a metering valve 153, having a visible vacuum/pressure gauge 155 attached thereto. The metering valve 153 may be selectively set to control the water supply rate (pressure) provided by the level of water in the water tank. Thus, in operation, the metering valve 153 acts as a vacuum or pressure regulator, as will be explained herein. The water supply channel may comprise, for example, a ⅜ inch copper tube connected to the metering valve and to the heat exchanger via a drain pipe 131. The water supply line 157 provides water from the water tank that enters the heat exchanger at the drain tube 131 which, in operation, is normally closed off using the manually operable valve 132, such as a ball valve, connected to one end of the drain tube. When opened, the drain tube valve 132 may be used to drain and flush the heat exchanger when the steam generator system 100 is not in use.

A vacuum pump 108, or vacuum blower, may include a Roots type blower, for example, that is fluidly connected to the heat exchanger via a channel 129, referred to herein as a steam supply channel, for drawing and discharging steam generated in the heat exchanger. The steam channel 129 may include a high temperature rubber tube or steel pipe sized at about one and one-half inches. The vacuum blower 108 maintains a negative pressure (vacuum) within the heat exchanger and within the water supply channel 157 and serves to draw water from the water supply through the metering valve 153 into the heat exchanger 104, where the water is boiled to generate steam, and also draws the generated steam from the heat exchanger and discharges it through a steam line, such as a flexible rubber steam hose 135. In cooperation with the vacuum generated by the vacuum blower 108, the metering valve 153 may be set low enough to allow a flow rate of water sufficient to allow boiling the water in the heat exchanger at a lowered pressure and temperature but not so high as to decrease the pressure within the heat exchanger excessively such that the heat provided by the heated fluid is insufficient to boil the water and generate steam. Pressure in the steam supply channel 129 may be monitored by a visible pressure gauge 128 fluidly connected to the steam supply channel 129 via a ⅜ inch copper tube, for example. In one embodiment, the vacuum blower 108 may be set to provide about twelve to about twenty inches of vacuum (negative pressure), more preferably about sixteen inches of vacuum. The higher the vacuum provided by the vacuum blower 108 the higher will be the temperature of the steam discharged from the steam hose 135. In general terms, depending on several variables such as temperature of the water supply, current atmospheric pressure, etc., if the boiler is set to provide circulating heated fluid at about 180° F., a twelve inch vacuum pressure supplied by the vacuum blower may result in steam discharged from the vacuum blower at about 212° F., a sixteen inch vacuum may result in steam discharged from the vacuum blower at about 220° F. to about 230° F., and a twenty inch vacuum may result in steam discharged from the vacuum blower at temperatures approaching about 300° F. The scale for defining vacuum pressure as used herein is known as "inches of mercury vacuum" (inHg).

The pressure within the heat exchanger is maintained at less than one standard atmosphere of pressure due to the vacuum blower continuously drawing the steam from the heat exchanger through the steam supply channel 129. Connected to the vacuum blower 108 is a standard electric motor 106, which may used to drive the vacuum blower 108. The electric motor may be sized at about three horsepower. A visible temperature gauge 127 may be attached to the vacuum blower 108 to monitor a temperature of the steam at the vacuum blower 108. In one embodiment, the heat exchanger 104 may include a plate heat exchanger, such as a brazed plate heat exchanger, for example. The plate heat exchanger includes a high surface area for efficient transfer of heat from the heated fluid to the water. In other embodiments, the heat exchanger may include further suitable types of heat exchange technologies. The lowered pressure within the heat exchanger allows the heated water to boil and be converted to gaseous form as steam at a lower temperature as compared to a standard atmospheric pressure boiling temperature. The steam is drawn from the heat exchanger 104 through the steam supply tube 129 by the vacuum blower and is discharged through the steam hose 135, which hose has a first end fluidly connected to the vacuum blower and a second open end for discharging the steam. The steam generated within the heat exchanger at the lowered pressure and temperature increases in temperature beyond the standard boiling point of water when exposed to the higher pressure of the exterior atmosphere and so is maintained in its gaseous phase as it is propelled through the open second end of the steam hose.

The heat exchanger includes at least four steel pipes, e.g., sized at about one and one-half inches, extending therefrom each having a flanged end 124 to fluidly connect the heat exchanger to the heating fluid supply channel 121, the heating fluid return channel 122, the steam supply channel 129, and the drain channel 131. Matching flanges on each of these channels may be connected to the heat exchanger flanges using standard components such as nuts, bolts, and gaskets. A table 133 may include dimensions of about 36"×36"×20" depending on the component size and arrangement, and may be used to arrange and support several of the components of the steam generator system 100 as described herein. While the present invention is not limited to particular sizes of components, or to particular materials comprising the various components described herein, several preferred material examples and component sizes will now be mentioned. The fluid heated by the boiler 102 may comprise a glycol based fluid for example, ethylene glycol which is often used as automobile coolant. The boiler may have a capacity of approximately 250,000 BTU's, for example. The steam hose 135 may comprise standard half-inch or ⅝ inch high temperature rubber hose. The size of the heat exchanger in one embodiment may be about 16 inches by 12 inches by 4 inches. It is to be understood that these are exemplary materials and dimensions and various other sizes and dimensions and materials may be used and is considered within the scope of the present invention.

In a continuous operation mode, the steam exiting the heat exchanger at the lowered pressure through steam supply tube 129 is discharged into the hose 135 at the higher standard atmospheric pressure by the vacuum blower 108 and is expelled through the open end of the hose. The steam provided thereby may be manually aimed by manipulating the free end of the steam hose wherever heat is necessary to thaw or heat objects, components, or industrial equipment, to melt ice, or otherwise provide a source of heated gas (water vapor) as desired. The continuous operation of the vacuum pump maintains the interior pressure, at least within the heat exchanger and the steam supply tube, at less than the atmospheric pressure existing in the environment immediately outside the steam generator apparatus 100, which may be referred to herein as one standard atmosphere. When the steam exits the vacuum blower 108 and enters the hose it is exposed to the pressure of the exterior standard atmosphere which is greater than the internal pressure of the heat exchanger. The increased pressure of the standard atmosphere raises the temperature of the steam ejected by the vacuum blower 108 so that it may remain in its gaseous state at the higher pressure of the exterior atmosphere. The continuous supply of ejected steam from the vacuum blower at the first end of the steam hose pushes the steam and any condensed water through the steam hose to be output at the open second end thereof. A nozzle (not shown) may be attached to the second end of the steam hose to provide a more directed flow of steam or to provide a handle for manipulating the hose, for example.

The water tank 110 may comprise any one of various sizes. In one embodiment the water tank might contain a cubic meter of water or it may contain anywhere from about 50 to 500 gallons of water or more. The water supply may also be sourced from a municipal water supply which may provide an unlimited but finite amount of water. Because the pressure provided by a municipal supply may force the water through the supply line 157 at a rate that might diminish the performance of the steam generator 100, it becomes necessary to control the flow rate (pressure) at the metering valve 153. In general, because of the decreased pressure within the steam generator apparatus 100 provided by the vacuum blower 108, the heat exchanger need only heat the water to its boiling point at the lower pressure, or slightly higher, to generate steam therein, e.g., a temperature of about 180° F. or ranging from about 160° F. to about 200° F. as desired. The temperature of the generated steam in the heat exchanger will increase when it reaches the atmospheric pressure outside of the steam generator 100, such as in the hose 135 whose interior is exposed to the atmospheric pressure of the environment outside the apparatus 100.

Figure 2:
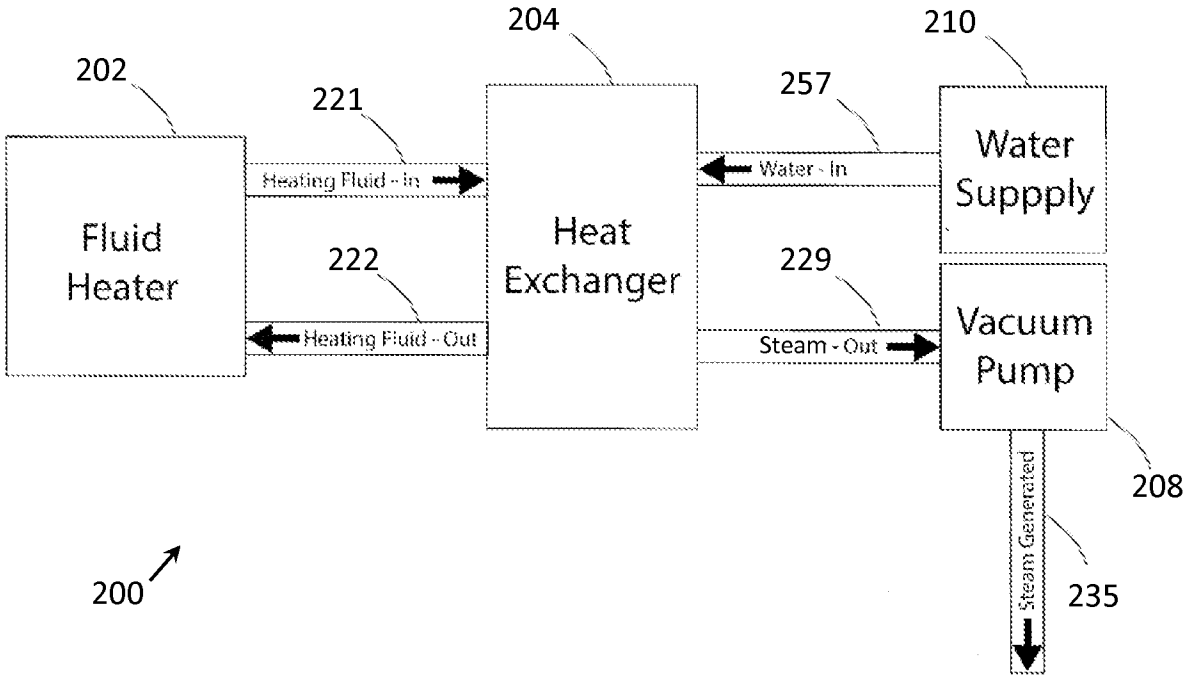
FIG. 2 is a flow diagram illustrating functional relationships of the exemplary components shown in FIG. 1.

With reference to FIG. 2 there is illustrated a flow diagram 200 depicting the functional operation of the steam generator system 100. The flow diagram 200 illustrates functional relationships as between several of the components illustrated in FIG. 1. The fluid heater or boiler 202 is in fluid communication with the heat exchanger 204 by supplying heated fluid through a heating fluid-in line 221, which heated fluid circulates through the heat exchanger 204 and returns to the fluid heater 202 via heating fluid-out line 222 to be reheated therein. Thus, the fluid heater 202 maintains the heating fluid at a substantially constant temperature as it circulates through the heat exchanger. Also connected to the heat exchanger is a water supply 210. The water supply is also in fluid communication with the heat exchanger by supplying water thereto through water supply line 257. The water from the water supply 210 travels through the heat exchanger 204 and is heated therein up to or higher than its boiling point at the lowered pressure in the heat exchanger. The heated water is converted to steam and exits the heat exchanger through a steam-out line 229 and enters a vacuum pump 208 which ejects the steam through a hose 235. The boiler 202 on the left circulates the heated fluid through the heat exchanger 204 and may be described as a closed loop system for heated fluid. On the companion side of the heat exchanger 204 the vacuum pump (blower) draws the flow of water from the water supply through the heat exchanger and also ejects the steam. The water from the water supply 210 to the steam-out line 229, as it flows through the water supply line 257 and the heat exchanger 204 and is converted to steam therein, and as it exits the heat exchanger as steam, is drawn by a vacuum and so is maintained at a pressure that is lower than the pressure immediately outside of the steam generator 100. As the steam is ejected from the vacuum pump into the hose 235, the steam is exposed to atmospheric pressure because the open end of the hose 235 is in fluid communication with the atmosphere. The increase in pressure further increases the temperature of the steam being ejected by the vacuum pump which is sufficient to maintain the steam in its gaseous phase. The steam exits the open end of the hose, which may be manually handled to direct the steam at any object desired.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

PARTS LIST

100 steam generator
102 boiler/heater
104 heat exchanger
106 electric motor
108 vacuum pump/blower
110 water tank
121 heating fluid supply channel
122 heating fluid return channel
123 valve
124 flange
125 vent
127 gauge
128 gauge
129 steam supply channel
131 drain tube

132 valve
133 support table
135 hose
151 fill hole—capped
153 valve
155 gauge
157 water supply channel
159 water tank base
200 steam generator functional diagram
202 fluid heater
204 heat exchanger
208 vacuum pump/blower
210 water supply
221 heating fluid-in channel
222 heating fluid-out channel
229 steam-out channel
235 steam channel
257 water supply-in channel

What is claimed is:

1. A steam generating apparatus comprising:

a heater for heating a fluid and for circulating the heated fluid through a heating tube;

a supply of water for supplying water through a water supply tube;

a heat exchanger containing part of the heating tube that receives the heated fluid from the heater for circulation through the heat exchanger and returns the fluid to the heater through a return line as part of a closed loop, the heat exchanger being fluidically connected to the water supply via the water supply line in which the heat exchanger receives the water from the water supply, for heating the received water and for generating steam;

a vacuum pump fluidly connected with the heat exchanger and an exhaust hose, the vacuum pump being coupled to the heat exchanger for drawing the generated steam from the heat exchanger and injecting the steam into a first end of the exhaust hose, in which the heater heats the fluid to a temperature less than the boiling point of the water at a standard atmospheric pressure and the vacuum pump maintains a pressure in at least a portion of the water supply line less than the pressure of an atmosphere immediately outside of the apparatus;

wherein the exhaust hose outputs the steam through a second end thereof.

2. The steam generating apparatus of claim 1, wherein the fluid circulating between the heater and the heat exchanger through the heating tube comprises a glycol-based fluid.

3. The steam generating apparatus of claim 1, wherein the heating tube comprises a tube made from rubber.

4. The steam generating apparatus of claim 1, wherein the heater is an electric heater, a boiler, a gas heater, an oil heater, or a combination thereof.

5. The steam generating apparatus of claim 1, wherein the supply of water comprises a water tank holding about 50 gallons of water to about 500 gallons of water.

6. The steam generating apparatus of claim 1, wherein the supply of water is sourced from a municipal water supply providing a finite supply of water.

7. The steam generating apparatus of claim 1, wherein an interior of the exhaust hose is exposed to the pressure of the atmosphere immediately outside of the apparatus.

8. A method of generating steam comprising:

continuously circulating a heated fluid from a heater through a heat exchanger using a closed loop system that returns the fluid to the heater;

maintaining a pressure in the heat exchanger at less than atmospheric pressure using a vacuum source;

heating water in the heat exchanger under the less than atmospheric pressure past its boiling point at the less than atmospheric pressure to generate steam;

heating the water using the heat exchanger up to a temperature sufficient to maintain the water as steam when the steam is discharged into the environment at the atmospheric pressure; and drawing the steam from the heat exchanger using the vacuum source and discharging the steam into an environment at atmospheric pressure using the vacuum source wherein the temperature sufficient to maintain the water as steam is less than the boiling point of the water at the atmospheric pressure.

9. The method of claim 8, further comprising circulating a heated glycol based fluid through the heat exchanger using an electrically powered boiler, a gas powered boiler, an oil powered boiler, or a combination thereof, for heating the fluid.

10. The method of claim 8, further comprising providing a water tank containing water and drawing the water from the water tank into the heat exchanger using a water line.

11. A steam generator comprising:

a supply of water;

a boiler for heating a fluid;

a heat exchanger fluidly connected to the boiler for receiving the heated fluid, for continuously circulating the heated fluid and returning the fluid to the boiler in a closed loop, the heat exchanger being fluidly connected to the supply of water for receiving water, and for converting the received water to steam;

a vacuum pump fluidly connected to the supply of water for maintaining a pressure of the water supplied to the heat exchanger at less than atmospheric pressure and for drawing the steam from the heat exchanger and ejecting the steam into an environment at the atmospheric pressure wherein the boiler heats the fluid up to a temperature less than the boiling point of the water at the atmospheric pressure.

12. The steam generator of claim 11, further comprising a hose connected to the vacuum pump for receiving the steam therefrom at a first end of the hose and for discharging the steam through a second end of the hose at the atmospheric pressure.

13. The steam generator of claim 12, wherein the fluid comprises a glycol based fluid.

14. The steam generator of claim 13, wherein the boiler comprises an electric boiler, a gas boiler, an oil boiler, or a combination thereof.

15. The steam generator of claim 14, wherein the supply of water comprises a water tank holding about 50 gallons of water to about 500 gallons of water.

* * * * *